US007100622B2

(12) United States Patent
MacNeil et al.

(10) Patent No.: US 7,100,622 B2
(45) Date of Patent: Sep. 5, 2006

(54) PIPE SCARIFIER

(75) Inventors: Gerard J. MacNeil, Surrey (CA); David B. MacNeil, Langley (CA); Gordon W. MacNeil, Delta (CA); Vernon G. Bose, Langley (CA)

(73) Assignee: Mac & Mac Hydrodemolition Inc., (CA)

( * ) Notice: Subject to any disclaimer, the term of this patent is extended or adjusted under 35 U.S.C. 154(b) by 401 days.

(21) Appl. No.: 10/434,574

(22) Filed: May 9, 2003

(65) Prior Publication Data

US 2004/0099293 A1 May 27, 2004

(30) Foreign Application Priority Data

Nov. 25, 2002 (CA) ..... 2412693

(51) Int. Cl.
*B08B 3/02* (2006.01)

(52) U.S. Cl. ..... 134/169 R; 134/168 R; 239/750

(58) Field of Classification Search ..... 134/169 R, 134/168 R, 181, 167 R; 451/76; 239/750, 239/264, 265
See application file for complete search history.

(56) References Cited

U.S. PATENT DOCUMENTS 1,872,178 A * 8/1932 Peik ..... 451/85
2,063,054 A * 12/1936 Rosenberger ..... 451/75
2,628,455 A * 2/1953 Webster ..... 451/2
2,710,225 A * 6/1955 Richards ..... 239/752
2,728,238 A * 12/1955 Paasche ..... 74/99 R
2,903,189 A * 9/1959 Patton ..... 239/129
2,963,876 A * 12/1960 Hibbs, Jr. ..... 62/173
3,027,095 A * 3/1962 Paasche ..... 239/752
3,973,730 A * 8/1976 Johnson ..... 239/752
5,762,083 A * 6/1998 Bate ..... 134/167 C
6,102,157 A * 8/2000 Goldbach et al. ..... 182/128
6,206,016 B1 3/2001 MacNeil et al.

FOREIGN PATENT DOCUMENTS

JP 5-228407 * 9/1993
JP 6-277579 * 10/1994
JP 1177543 * 3/1999

* cited by examiner

*Primary Examiner*—Frankie L. Stinson
(74) *Attorney, Agent, or Firm*—Vermette & Co.

(57) ABSTRACT

A scarifier for scarifying an interior surface of a sewer pipe, which includes an elongated frame having spaced apart upstanding frame elements at either end forming a plurality of guide surfaces on each side. A first track extends from one end of the frame to another, reversibly moveable upwardly along a first set of the guide surfaces on a first side of the frame in response to a control signal, which controls a drive system coupled to the track. A nozzle assembly is reversibly moveable along the track from one end of the scarifier to another so that a nozzle, mounted on the nozzle assembly, which emits a jet of fluid towards an interior surface of the sewer pipe, is operative to scarify a swath along the interior surface.

15 Claims, 2 Drawing Sheets

PIPE SCARIFIER

FIELD

The present invention relates to a pipe scarifier for removing corroded and contaminated material from the interior of a concrete pipe such as a sewer pipe and expose a fresh surface which can then be sealed.

BACKGROUND

Previously known scarifiers for scarifying the interior of a concrete pipe consisted of a moveable vehicle equipped with rotating nozzles positioned adjacent to the interior surface of pipe which impart high pressure jets against the interior surface to remove contaminated and corroded material. The removal of such material leaves a fresh concrete surface which can then be sealed with polyvinyl chloride to prevent any future deterioration of the interior surface. With a scarifier as disclosed in our U.S. Pat. No. 6,206,016 which has a nozzle assembly at the distal end of an arm which positions the nozzle assembly adjacent the interior surface of the pipe, a swath is cut into the pipe surface as the vehicle moves down the pipe. If the material removed falls into the path of the vehicle then, when the vehicle reverses and retraces its path to scarify a new swath adjacent the previous one, it will rise up and down as it runs over the material previously removed by scarifying and cause the swath to move vertically and leave some areas with contaminated or corroded material. For example, some sewer lines have tile embedded in concrete extending part-way or all the way up the sewer wall. Scarifying each swath of the tile along the length of the pipe results in broken pieces of tile falling down on the sewer floor. Reversing to scarify a new swath requires removal of the pieces of tile from the previous swath in order to prevent generating an uneven swath and, thus, leaving regions of corroded and contaminated material on the wall.

Accordingly, it is an object of the invention to provide a scarifier of an interior surface of a pipe which is unaffected by the removal of large pieces of material from the interior surface.

SUMMARY OF THE INVENTION

According to the invention there is provided a scarifier for scarifying an interior surface of a sewer pipe, which includes an elongated frame having spaced apart upstanding frame elements at either end forming a plurality of guide surfaces on each side. A first track extends from one end of the frame to another, reversibly moveable upwardly along a first set of the guide surfaces on a first side of the frame in response to a control signal which controls a drive system coupled to the track. A nozzle assembly is reversibly moveable along the track from one end of the scarifier to another so that a nozzle, mounted on the nozzle assembly, which emits a jet of fluid towards an interior surface of the sewer pipe, is operative to scarify a swath along the interior surface.

Preferably, the scarifier rests on the elongated frame during operation of the nozzle assembly.

A set of wheels is mounted on either end of the elongated frame, and are moveable from an extended position in which the elongated frame is raised from a support surface of the wheels and is supported by the wheels, to a retracted position in which the elongated frame rests on the support surface.

Alternatively, a set of endless belts may be mounted on either side of the lower frame elements and be moveable so as to move the scarifier.

In addition to the endless belts, a frame support assembly may be coupled to the scarifier and be operative to stabilize the scarifier when the nozzle assembly moves along the track and the nozzle is operative to emit a jet of fluid.

Advantageously, the frame support assembly may include a plurality of spaced apart telescopically extendible pads extendible to a position in which they support the scarifier.

Preferably, the track moves substantially horizontally along the set of guide surfaces.

The guide surfaces may have a profile which is substantially the same as a profile of the interior surface.

Advantageously, a second track is reversibly moveable, upwardly along a second set of the guide surfaces on a second side of the frame.

The wheels may be mounted at either end to an axle pivotally connected to the frame and a hydraulic piston-cylinder may be pivotally connected between the axle and the frame at a point above the connection of the axle to the frame.

A plate may be coupled to the track by wheels journalled to the plate and engaging both a top and a bottom of the track with the nozzle assembly coupled to the plate. A gear affixed to plate and engages a pinion gear affixed to the track, and a motor mounted on the plate and coupled to said gear, may be operative to reversibly drive the gear and the plate along the track.

A pair of chain drives coupled to respective ends of the track may be used to raise and lower the track in response to a control signal.

The nozzle assembly may be coupled to an end of a hydraulic ram affixed to the plate, the hydraulic ram being adjustably extendible and retractible so as to position the nozzle adjacent and substantially normal to an interior surface of the pipe.

BRIEF DESCRIPTION OF THE DRAWINGS

Further features and advantages will be apparent from the following detailed description, given by way of example, of a preferred embodiment taken in conjunction with the accompanying drawings, wherein.

DETAILED DESCRIPTION WITH REFERENCE TO THE DRAWINGS

Figure 1:
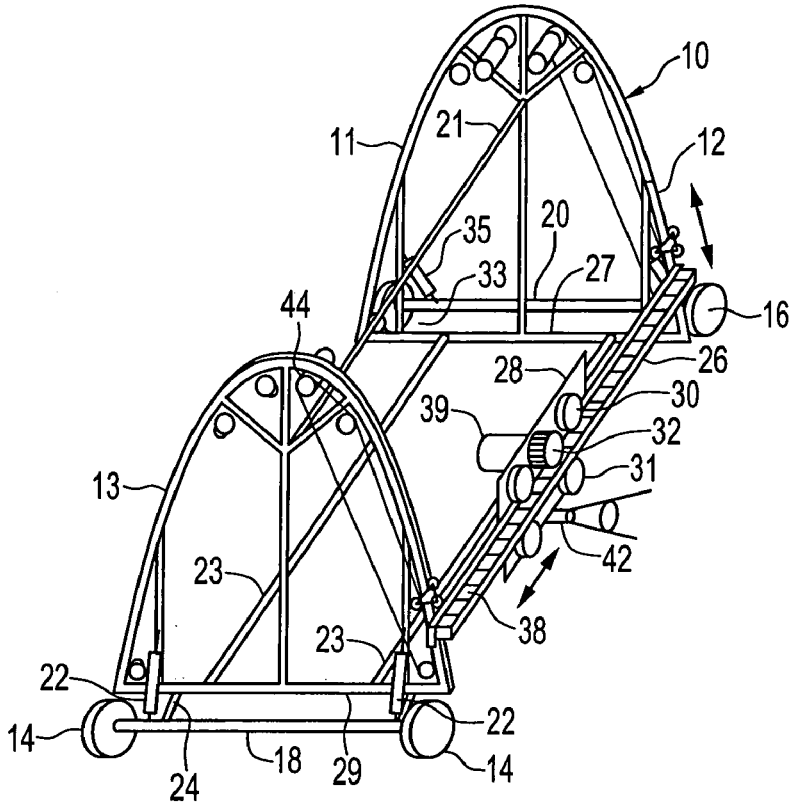
FIG. 1 is a perspective view of the scarifier.

Referring to FIG. 1, the scarifier 10 having a frame 11 consisting of two spaced apart arcuate frame end elements 12 and 13 joined together by elongated upper frame elements 21 and lower frame elements 23. Pairs of wheels 14 and 16 are mounted on axles 18 and 20. Axle 18 is pivotally attached by hinge bar 24 to transverse frame element 29 and axle 20 is pivotally attached by hinge bar 33 to transverse frame element 27. A set of piston cylinders 22 interconnect the axle 18 with a vertical frame element above the transverse frame element 29. Similarly piston cylinders 35 at the other end interconnect the axle 20 with a vertical frame element above the transverse frame element 27. Extension of the piston cylinders 22 and 35 cause the wheels 14 and 16, respectively, to raise the scarifier 10 off of the ground.

Figure 2:
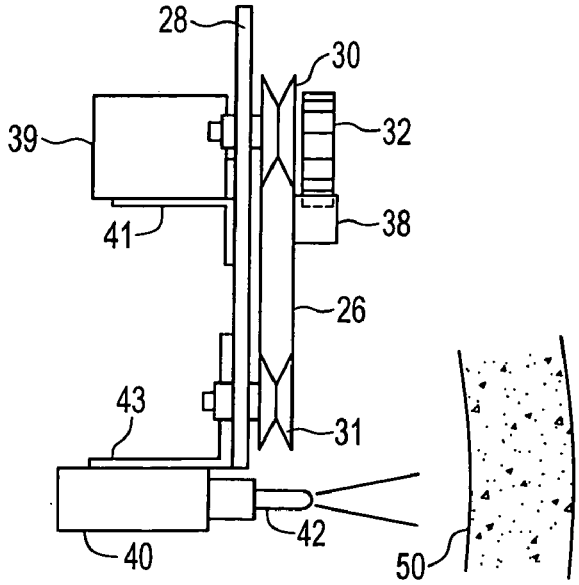
FIG. 2 is an elevation view of the scarifying assembly movement apparatus.

An elongated track 26 extends horizontally across both arcuate frame end elements 12 and 13 and is supported at each end by a chain drive assembly 44, which raises and lowers track 26. As seen in both FIGS. 1 and 2 pairs of sheave wheels 30 and 31 roll on the top and bottom edge of track 26 and support plate 28, to which wheels 30 and 31 are journalled. An elongated pinion gear 38 is affixed to an outside of track 26 and a gear 32 driven by a hydraulic motor 39, engages the teeth of pinion gear 38 and drives support plate 28 along track 26. A bracket 41 is attached to plate 28 and supports motor 39. Bracket 43 is also affixed to plate 28 and supports a piston cylinder 40, which supports and positions a jet nozzle 42. Water hoses, hydraulic cables and the like have been omitted for the purposes of clarity.

In operation, the scarifier is towed or moved into a pipe to be scarified with its wheels 14 and 16 down. Once in position in the pipe(not shown), the piston cylinders 22 and 35 cause the wheels 14 and 16 to be pivoted upwardly and lower the scarifier so that the lower frame elements 23 and transverse frame elements 27 and 29 rest on the bottom of the pipe. Track 26 is lowered to its lowermost position on the arcuate frames 12 and 13 and then motor 39 causes gear 32 to begin rotating and driving plate 28 horizontally. As plate 28 moves, a jet of water is directed out of nozzle 42 and onto an interior surface of the pipe 50 to scarify a swath. Once plate 28 reaches the end of track 26, track 26 is raised along the arcuate frames 12 and 13 an incremental amount approximately equal to the diameter the jet subtends at the interior surface of the pipe 50. Next the plate 28 is driven in a reverse direction to scarify a swath immediately above the previous swath. This process is continued until track 26 reaches the upper end of the arcuate frames 12 and 13. At the same time another track (not shown) operates on the other side so that the entire interior surface of the pipe 50 on both sides is scarified without having to move the scarifier 10. Next the frame 11 of the scarifier 10 is raised onto wheels 14 and 16 and moved along the bottom of the pipe to the next section to be scarified and the process is repeated. At no time is a swath affected by debris on the bottom of the pipe.

The shape of the arcuate frame end elements 12 and 13 is selected to largely conform with the walls of the pipe 50 to be scarified. The nozzle could be replaced with a rotating set of nozzles and branches and be positioned on the distal end of a short arm pivotal relative to another extendible arm. The extendible arm could be telescopically extendible or extendible by articulating movement. Alternatively, the nozzles could oscillate rather than rotate.

Alternatively, referring to FIG. 3, a set of endless belts 43 are mounted below the lower frame elements 23 and serve to drive the scarifier 10 from one working location to another. A set of support pads 45 are coupled to the pistons of hydraulic piston-cylinder units 41 at each corner of the scarifier 10 and extend to lift the frame 11 off of the tracks 43 and stabilize the frame 11 during the scarifying operation.

Figure 3:
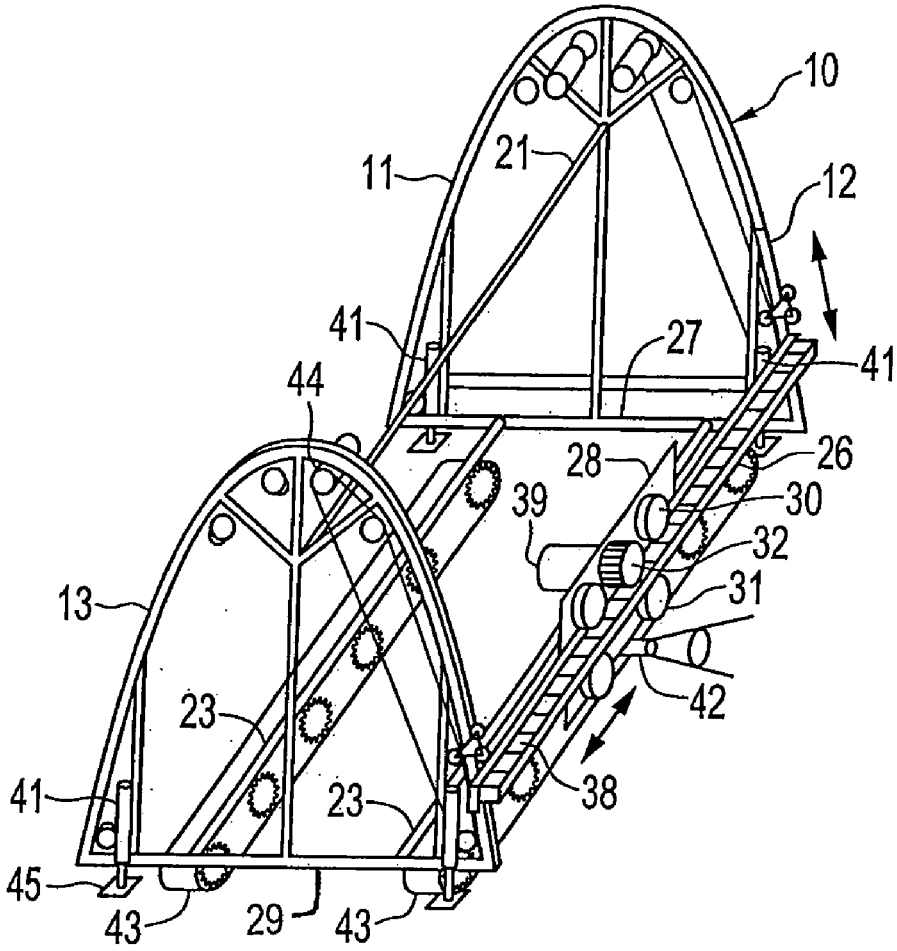
FIG. 3 is a perspective view of the scarifier having a pair of endless belts as the driving mechanism.

Referring to FIGS. 1 and 3, the chain drive assembly 44 includes electric motors to drive the chain sprockets (not shown). However, hydraulic or pneumatic motors could be used equally as well. The chain drive assembly 44 could be replaced with a rack and pinion assembly (not shown) or a cable system (not shown).

While the scarifier 10 is towed from one scarifying position to the next, it is obvious that a drive system could be used to move it. The drive system would include an axle gear attached to one of axles 18 and 20 (see FIG. 1), a motor gear and a reversible motor engageable with the axle gear when the wheels 14 and 16 are in a position of supporting the scarifier 10. Alternatively, the entire structure could be supported by two tracks on either side or it could be skid mounted.

It will be further obvious that although only two cleaning tracks and associated nozzle assemblies are shown, four or more tracks and associated nozzle assemblies could be used, with the tracks moveable only one-half as far over the arcuate frame end elements 12 and 13. In the latter case the scarifying speed would be approximately twice as fast as for an embodiment with only two tracks and associated nozzle assemblies.

It can also be appreciated that multiple nozzle assemblies could be mounted on each track to speed up the scarifying process. An external water source and pump could be used bringing high pressure hose to each nozzle assembly or, alternatively, a low pressure water line would be brought to the machine and fed to pumps servicing each nozzle assembly.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

We claim:

1. A scarifier for scarifying an interior wall of a sewer pipe, comprising:

(a) an elongated frame having spaced apart upstanding frame elements at either end and including a set of wheels mounted on either end of said elongated frame, moveable from an extended position in which said elongated frame is raised from a support surface by said wheels to a retracted position in which said elongated frame rests on said support surface;

(b) a first track extending from a first one of said frame elements to a second one of said frame elements reversibly moveable along a path defined by said frame elements in response to a control signal which controls a drive system coupled to said track; and (c) a nozzle assembly reversibly moveable along said track so that a nozzle, mounted on said nozzle assembly, which emits a jet of fluid towards an interior surface of said sewer pipe, is operative to scarify a swath along said interior surface.

2. The scarifier of claim 1, wherein said scarifier rests on said elongated frame during operation of said nozzle assembly.

3. The scarifier of claim 1, wherein said path defined by said frame elements is an arcuate path.

4. A scarifier according to claim 1, wherein said nozzle assembly moves substantially horizontally along said track.

5. A scarifier according to claim 1, wherein said frame elements have a profile such that as said first track moves along said path defined by said frame elements a distance between said interior surface and said nozzle assembly remains substantially constant.

6. A scarifier according to claim 1, including a second track extending from a first one of said frame elements to a second one of said frame elements, reversibly moveable, along a path defined by said frame elements.

7. A scarifier according to claim 6, wherein an additional nozzle assembly is moveable along said second track.

8. A scarifier according to claim 1, wherein at each end of said elongated frame said wheels are mounted to an axle pivotally connected to said frame and a hydraulic piston-cylinder is pivotally connected between said axle and said frame at a point above the connection of said axle to said frame.

9. A scarifier according to claim 1, including a pair of chain drives coupled to respective ends of said track and operative to raise and lower said track in response to a control signal.

10. A scarifier according to claim 1, wherein said nozzle assembly is coupled to an end of a hydraulic ram affixed to said plate which is adjustably extendible and retractible so as to position said nozzle adjacent and substantially normal to said interior surface of said sewer pipe.

11. A scarifier according to claim 1, wherein said nozzle assembly includes a branch and said nozzle is located at a distal end of said branch.

12. A scarifier according to claim 11, wherein said branch one of rotates and oscillates.

13. A scarifier for scarifying an interior wall of a sewer pipe, comprising:

(a) an elongated frame having spaced apart upstanding frame elements at either end, said frame including a plurality of spaced apart telescopically extendible pads mounted thereon, and a set of endless moveable belts mounted on either side of said elongated frame, said pads being extendible to a position in which they support said scarifier, said frame supported by and moveable on said endless belts when said pads are retracted;

(b) a first track extending from a first one of said frame elements to a second one of said frame elements, reversibly moveable along a path defined by said, frame elements in response to a control signal which controls a drive system coupled to said track; and (c) a nozzle assembly reversibly moveable along said track so that a nozzle, mounted on said nozzle assembly, which emits a jet of fluid towards an interior surface of said sewer pipe, is operative to scarify a swath along said interior surface.

14. The scarifier of claim 13, including a frame support assembly, coupled to said scarifier, operative to stabilize said scarifier when said nozzle assembly moves along said track and said nozzle emits a jet of fluid.

15. A scarifier for scarifying an interior wall of a sewer pipe, comprising:

(a) an elongated frame having spaced apart upstanding frame elements at either end;

(b) a first track extending from a first one of said frame elements to a second one of said frame elements, reversibly moveable along a path defined by said frame elements in response to a control signal which controls a drive system coupled to said track; and (c) a nozzle assembly reversibly moveable along said track so that a nozzle, mounted on said nozzle assembly, which emits a jet of fluid towards an interior surface of said sewer pipe, is operative to scarify a swath along said interior surface, wherein said scarifier further comprises a plate coupled to said track by wheels journalled to said plate and engaging both a top and a bottom of said track, said nozzle assembly coupled to said plate, a gear affixed to said plate and engaging a pinion gear affixed to said track, and a motor mounted on said plate and coupled to said gear, operative to reversibly drive said gear and said plate along said track.

* * * * *